United States Patent [19]

Whiddon

[11] Patent Number: 4,808,831

[45] Date of Patent: Feb. 28, 1989

[54] CONTAINER FOR WET AND DRY RADIOACTIVE SAMPLES

[75] Inventor: Orren P. Whiddon, Gaithersburg, Md.

[73] Assignee: Bioscan, Inc., Washington, D.C.

[21] Appl. No.: 29,969

[22] Filed: Mar. 25, 1987

[51] Int. Cl.[4] ..... G21F 5/02

[52] U.S. Cl. ..... 250/506.1; 250/496.1; 250/364

[58] Field of Search ..... 250/496.1, 506.1, 364; 206/569, 305; 220/82, 363, 364; 350/536; 356/244, 246; 422/102, 58, 61

[56] References Cited

U.S. PATENT DOCUMENTS 3,018,611 1/1962 Biritz ..... 422/58

3,690,836 9/1972 Buissiere et al. ..... 422/102

OTHER PUBLICATIONS

Davison, Journal of the Optical Society of America, vol. 45, No. 3, Mar. 1955, p. 227.

*Primary Examiner*—Bruce C. Anderson

*Assistant Examiner*—Jack I. Berman

*Attorney, Agent, or Firm*—Burns, Doane, Swecker & Mathis

[57] ABSTRACT

A sealed container for either wet or dry radioactive samples to be counted by an associated counter. The container includes a carrier having an aperture formed therethrough. A window is connected to one side of the carrier and defines a cavity with the carrier. The cavity is accessible via at least one aperture in the carrier. A tab is removably attached to another side of the carrier for sealing the aperture.

50 Claims, 5 Drawing Sheets

CONTAINER FOR WET AND DRY RADIOACTIVE SAMPLES

BACKGROUND OF THE INVENTION

I. Field of the Invention

This invention relates generally to the measurement of radioactivity of a sample in a container and, more particularly to a new and improved sample container for either wet or dry samples.

II. Background Description

In the biological and medical sciences, certain radioisotopes are frequently used as tracers in tests and experiments in order to detect minute quantities of certain biochemicals present in test samples. For example, the radioisotope $^{32}P$, is commonly used by researchers in these fields to label genetic material (DNA/RNA) and proteins. Frequently, it is required to know the precise amount of a radioisotope contained in various test samples. Quantitative measurements of the amount of radioactive material present in a test sample usually are expressed as an activity in disintegrations per minute. These measurements provide valuable information both in preparing the radio-labelled chemicals and in measuring an amount of radio-labelled material recovered from a system under investigation. Measurements of the activity of a sample also are needed to limit exposure to personnel handling the radioisotopes.

At the present time, most measurements of activity are obtained from scintillation counting or from Geiger counting. Scintillation counting uses photomultiplier tubes to detect photons produced in a scintillation medium in response to absorption by the medium of beta and gamma radiation. Many of the photons emitted from the scintillation medium are incident upon a photocathode of a multiplier phototube. These photons are converted to photoelectrons and are multiplied in number at a succession of phototube electrodes, called dynodes, the output of which is a measurable electrical pulse related to the incident radiation.

Liquid scintillation counters operate on the same basic principle as scintillation counters, except that the scintillation medium is a liquid into which is dissolved, suspended or otherwise intermixed the radioactive sample being tested. Radioactive emissions of a sample are measured by collecting photons emitted from the scintillation medium and generating photoelectrons responsive thereto to produce electrical pulses related to the incident beta and gamma radiation.

Scintillation and liquid scintillation counting require special sample preparation and the use of special sample containing vials in order to provide a quantitative measure of the amount of radioactive material present in a particular sample. Accordingly, an extra material handling step, involving a transfer of radioactive material into one of the special vials, is required when using these techniques. This transfer step is undesirable, for it is accompanied by an element of error in the measurement of material transferred to the vials. When this measurement error is added to the error inherent to the particular experiment or test technique being utilized, further uncertainty as to the accuracy of the quantitative data obtained from the sample results. Furthermore, the preparation of even a small amount of material for scintillation counting results in the loss of that material for further experimentation. In many cases, where only a very limited quantity of material is available this loss may be unacceptable.

Geiger counters are generally used when counting small numbers of samples. These counters provide a simpler but much less reliable means for measuring an approximate activity of a radiation emitting sample. Geiger counters use gas filled tubes the contents of which are ionized by incident radiation to produce an electronic signal which registers on a meter or in an audio circuit. The magnitude of the electronic signal is proportional to the amount of radiation impinging upon the gas filled tubes. Commercial Geiger counters are generally hand held devices whose quantitative accuracy is limited by uncertainties in the geometrical positioning of the sample relative to the detector and the absence of careful calibration techniques. However, the instruments are very useful in determining the presence and/or location of radioactivity and in determining an approximate activity of the sample for safe handling considerations. Geiger counters are also helpful in assessing the progress of certain chemical reactions or experiments.

At the current time, the vast majority of low energy radioisotope samples are counted using the technique of scintillation counting. The lowest energy samples such as tritium ($^{3}H$), carbon-14 ($^{14}C$), sulfur-35 ($^{35}S$), and phosphorus-32 ($^{32}P$) are counted using liquid scintillation counting (LSC). Liquid samples to be counted are placed in standard LSC vials, mixed with scintillation chemicals which fluoresce when excited by the low energy radiation, and counted in an instrument which detects the light flashes produced inside the vials. In the case of the highest energy of these isotopes ($^{32}P$), Cerenkov light is also produced by the interaction of the radiation with water or glass without the addition of a special scintillation chemical, and this light can also be counted by the LSC instrumentation.

For higher energy radiation, such as gamma emitters iodine-125 ($^{125}I$) and technetium-99m ($^{99m}TC$), samples can be counted with a solid scintillation crystal. The gamma radiation is much more penetrating than the beta radiation of the isotopes cited above and can penetrate the walls of a container and enter a crystal detector which produces light in response to the emitted radiation. Again, the light flashes are counted by the instrumentation.

These techniques require samples in large standard vials (from approximately 10–25 cc volume). The vials are generally made from plastic or glass of sufficient thickness to absorb essentially all of the low energy beta emissions from carbon-14 and sulfur-35. For these low energy beta emitting isotopes, the samples must be mixed with a scintillation chemical to produce the desired light flashes. This chemical also destroys most biological activity, rendering the counted samples unsuitable for further biological experimentation. There are also problems of compatibility between sample and scintillant including phase separation and coloration which must be eliminated or measured to obtain accurate results. In addition, the samples once counted must be disposed of, and there are significant volumes of liquid radioactive waste generated.

Another type of sample preparation in the prior art is the planchette used with a planchette counter, proportional and Geiger counters. In these devices, the liquid sample is spread and dried on a metal or paper surface. After drying, it can then be introduced into the sensitive gas volume of a proportional or Geiger counter which counts the radioactivity.

A currently available detector is a compact, bench top radiation detection apparatus capable of measuring the radiation in samples placed in any of a plurality of different sized and shaped containers through the provision of removable sample holders configured to receive different sample containers. Thus, the apparatus can measure the radiation from sample containers. Thus, the apparatus can measure the radiation from samples in the form of a liquid in a vial when the energy of the emissions are sufficient to penetrate the wall of the vial, as well as from samples which have been deposited and dried on the surfaces of specially shaped disposable sample containers which can be inserted into an associated sample holder and positioned at a fixed distance from a radiation detector with the sample in direct communication with the detector. This latter arrangement enables an efficient and accurate measurement to be made due to the absence of a container wall between the sample and the detector. It also allows the apparatus to be used to detect and measure low energy emissions. The vials however, have the limitations mentioned above.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

OBJECTS AND SUMMARY OF THE INVENTION

In view of the foregoing, it is an object of the present invention to reduce the amount of radioactive waste which must be disposed of.

It is another object of the present invention to limit the amount of handling, mixing or addition of other toxic chemicals in the sample container.

It is yet another object of the present invention to enhance retention of the biological activity of the samples and recovery for use in further biological experimentation.

It is a further object of the present invention to provide a sample container with a sufficiently thin exit window for permitting significant amounts of radioactive emissions to penetrate out of the container and into a direct ionization detector.

It is a still further object of the present invention to provide a sample holder in which either a wet or a dry sample can be sealed and analyzed.

In one aspect of the present invention, this is accomplished by providing a container for radioactive samples including a carrier having an aperture formed therein. Means connected to one side of the carrier and forming a cavity therewith are provided for retaining a liquid or dry radioactive sample in the cavity and for simultaneously permitting radiation from the sample to exit therethrough. The cavity is accessible via the aperture in the carrier. Other means are provided to be removably attached to the carrier for sealing the aperture.

The foregoing and other aspects will become apparent from the following detailed description of the invention when considered in conjunction with the accompanying drawing Figures. It is to be expressly understood, however, that the drawing is not intended as a definition of the invention but is for the purpose of illustration only.

BRIEF DESCRIPTION OF THE DRAWING FIGURES

DETAILED DESCRIPTION OF THE PREFERRED EMBODIMENT

Figure 1:
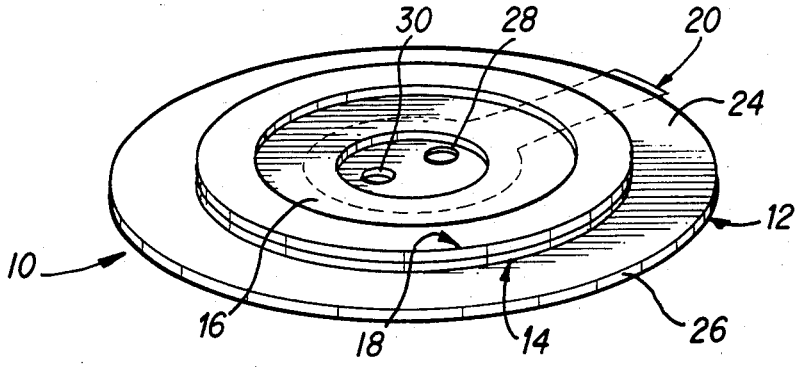
FIG. 1 is a perspective view illustrating one side of an embodiment of the container of the present invention.
Figure 2:
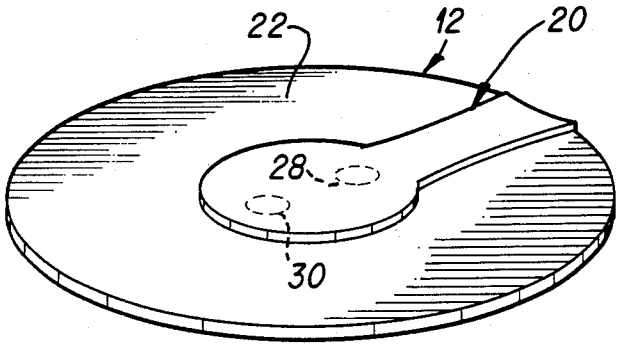
FIG. 2 is a perspective view illustrating an opposite side of the container of FIG. 1.

A container for radioactive samples is generally designated 10 in FIG. 1. Container 10 comprises a laminate type of structure including a carrier 12, spacer 14, window 16, window spacer 18 and a tab 20, see also FIGS. 2 and 3.

Carrier 12, also referred to as a carrier member or a carrier layer, is a generally planar, disk-shaped member having a thickness of about 0.014 inches and is preferably formed of a synthetic material such as the plastic film sold under the trademark Mylar. Carrier 12 includes opposed surfaces 22, 24, an outer periphery 26 and has at least one aperture 28 formed therein. For some applications, another aperture 30 is provided.

Spacer 14, also referred to as a spacer member, volume spacer and a first spacer layer, is a generally planar, disk-shaped member having a total thickness of about 0.020 inches and may be formed of two layers of laminated, double-sided tape or a single layer of suitable non-porous material. Spacer 14 includes an outer periphery 38 and an inner periphery 40 defining an opening 41 formed therethrough. Opposed surfaces 34, 36 include an adhesive 42 thereon. Surface 34 of spacer 14 is adhered to surface 24 of carrier 12 by adhesive 42.

Window 16, also referred to as a window member or a transparent window layer, is a generally disk-shaped member preferably formed of a synthetic material such as the plastic film commonly known as 6C or 12C Mylar sold by the DuPont Company of Wilmington, Del., and is of a thickness sufficient to contain a sample and to permit beta or other low energy radiation to pass therethrough. Window 16 is attached to surface 36 of spacer 14 by adhesive 42. In this manner a cavity 44 is defined by surface 24 of carrier 12, inner periphery 40 of spacer 14 and window 16. Cavity 44 is accessible via aperture 28 of carrier 12. Window 16 therefore functions as a means for retaining a radioactive sample in container 10 and simultaneously for permitting beta and other low energy radiation from the sample to exit therethrough.

Window spacer 18, also referred to as spacer means or a second spacer layer, is a generally disk-shaped member having a total thickness of about 0.010 inches and is preferably formed of two laminated layers. One of the layers being a synthetic material such as the plastic film sold under the trademark Mylar and the other layer being the double-sided tape mentioned above which includes adhesive 42. Window spacer 18 includes opposed surfaces 46, 48, an outer periphery 50 and an inner periphery 52 defining an opening 54 formed therethrough. Surface 46 of window spacer 18 is adhered to window 16 and to surface 36 of spacer 14 by adhesive 42.

Tab 20 includes an adhesive on a surface 21 thereof for permitting tab 20 to function as a well-known means to be removably attached to surface 22 of carrier 14 for sealing aperture 28, or in some cases to simultaneously seal apertures 28 and 30.

Figure 4:
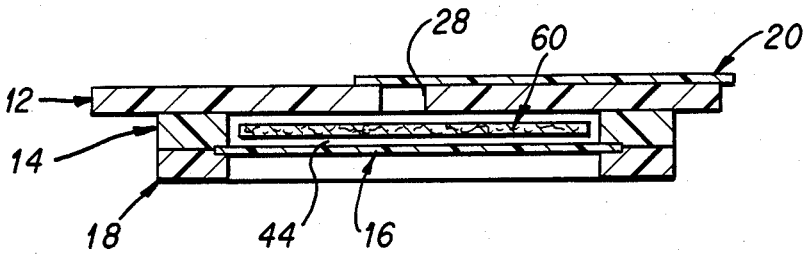
FIG. 4 is an enlarged cross-sectional view illustrating another embodiment of the present invention including a blotter.
Figure 6:
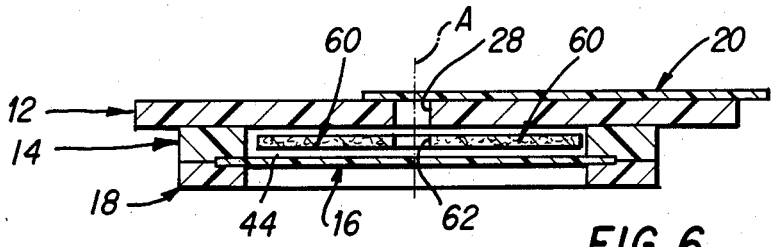
FIG. 6 is an enlarged cross-sectional view illustrating still another embodiment of the present invention including another blotter.
Figure 6A:
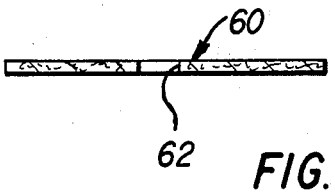
FIG. 6A is an enlarged cross-sectional view illustrating the blotter used in the embodiment of FIG. 6.

A blotter 60, FIG. 4, may be placed in cavity 44. Blotter 60 is generally disk-shaped and sized to fit within cavity 44, and may be formed of a suitable wicking material such as a blotter paper, mesh, or fibrous material. In the embodiment of FIGS. 6 and 6A, blotter 60 is illustrated as having an aperture 62 formed therein. Blotter 60 is preferably any suitable material that exhibits capillary wicking and has some thickness, such as a hydrophilic material. In this manner, samples can be evenly distributed in cavity 44 and spacing is maintained between window 16 and carrier 12.

Figure 3:
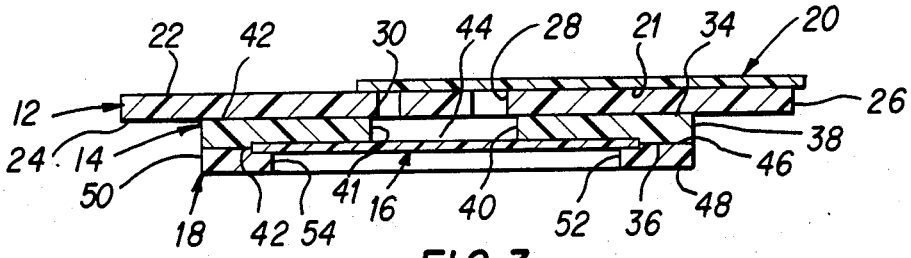
FIG. 3 is an enlarged cross-sectional view illustrating an embodiment of the present invention.

In one embodiment, FIG. 3, a large volume sample container includes carrier 12 which is sufficiently rigid to provide structure. Spacer 14 includes inner periphery 40, determined by the dimensions of an associated detector for measuring radioactivity. Window 16 is chemically compatible with most solvents, thin enough to transmit low energy betas and has low permeability to keep a sample from evaporating during a measurement (which would change the counting efficiency).

Carrier 12 is provided with two apertures 28, 30 adjacent periphery 40 of spacer 14 to take advantage of capillary wicking to draw a sample into cavity 44 and to simultaneously allow air to be displaced by a liquid sample. These apertures 28, 30 can be sealed with adhesive backed tab 20 to limit evaporative losses which would change the counting efficiency. Sealing tabs 20 also completely enclose the radioactivity in cavity 44 to limit hazardous handling.

The sample volume is determined by the diameter of periphery 40 and the thickness of spacer 14. The diameter is selected to correspond with the associated detector. The thickness of spacer 14 is chosen to make a sample volume of a desired size.

In FIG. 4, carrier 12 includes one central sample access aperture 28. Contained inside cavity 44 is blotter 60. The characteristics of blotter 60 are chosen to: a) controllably and uniformly disperse the liquid sample throughout the internal volume of cavity 44; b) to uniformly and controllably space window 16 away from carrier 12; and c) to have as low a density as possible to maximize transmission of the low energy betas while still maintaining features a and b mentioned above. Aperture 28 is sealed by tab 20. If desired, blotter 60 may be adhered to carrier 12 with a light adhesive. Spacers 14, 18 and window 16 are substantially the same as described above.

Figure 5:
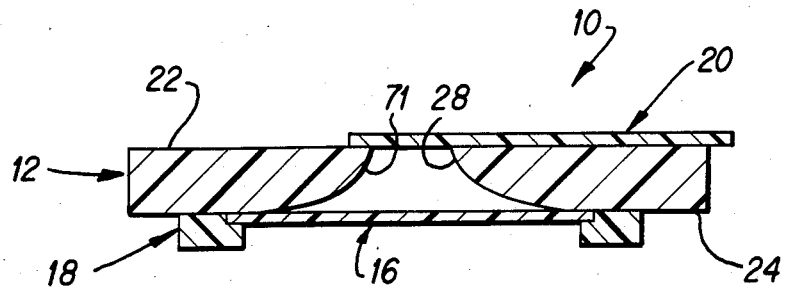
FIG. 5 is an enlarged cross-sectional view illustrating yet another embodiment of the present invention.
Figure 5A:
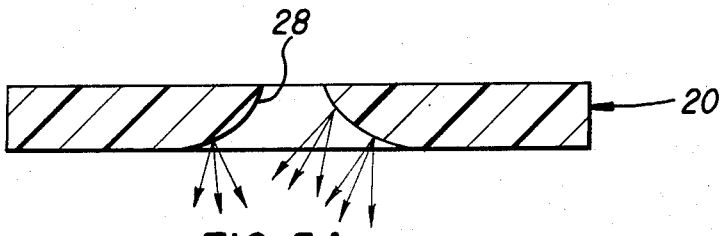
FIG. 5A is a graphical representation illustrating exposure patterns for material used in the embodiment of FIG. 5.

In FIG. 5 a high efficiency dry sample container 10 includes a modified carrier 12 having a greater thickness than in the above-mentioned embodiments. Carrier 12 is further modified in such a way as to maximize the deposition of the low energy isotope containing sample near the central region of the container and to provide an optimum emission solid angle into the detector, see also FIG. 5A. This is accomplished by a modified aperture 28 so as to gradually enlarge via a curved peripheral wall 71 as aperture 28 extends from surface 22 to opposed surface 24 of carrier 12. Thus, radio labelled material deposited on wall 71 of carrier 12 will have a greater exposure to an associated detector than would occur with a straight walled aperture as discussed above. Aperture 28 is sealed by tab 20 adhered to surface 22. Spacer 18 and window 16 are substantially the same as described above.

In FIG. 6, a DNA liquid sample container includes carrier 12 having a single aperture 28. However, blotter 60 in cavity 44, is modified to include aperture 62 formed therein coaxially with aperture 28 of carrier 12. DNA or other molecules which strongly bind to blotter 60 will preferentially bind to the edges of central aperture 62 thus minimizing the absorption of the betas by the main body of blotter 60. Aperture 28 is sealed by tab 20. Spacers 14, 18 and window 16 are substantially the same as described above.

In the embodiments illustrated herein, a preferred construction includes carrier 12, volume spacer 14, blotter 60, window 16 and window spacer 18 being interconnected so as to have a common centroidal axis designated A. Furthermore, carrier aperture 28, spacer opening 41, blotter aperture 62 and window spacer opening 54 also have the same centroidal axis A as illustrated in the drawing.

Figure 7:
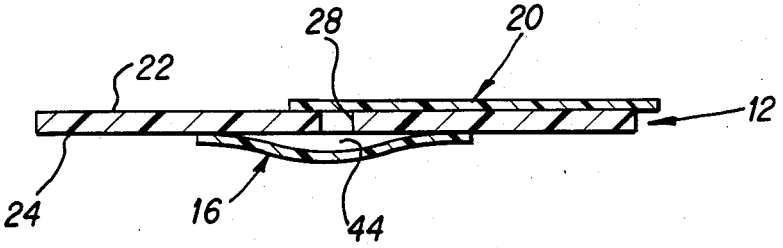
FIG. 7 is an enlarged cross-sectional view illustrating an embodiment of the present invention wherein a window and a tab are attached to opposite sides of a carrier.

From the foregoing it can be seen that dimensions of volume spacer 14 function to maintain a space, or cavity 44, between carrier 12 and window 16. In FIGS. 7–10A, it is illustrated that a suitable container 10 can include means other than spacer 14 to provide the desired cavity 44. In FIG. 7 a window 16 is suitably tensioned and adhered directly to surface 24 of carrier 12 in a manner sufficient to define a cavity 44 therebetween. Tab 20 is attached to surface 22 of carrier 12 for sealing aperture 28.

Figure 8:
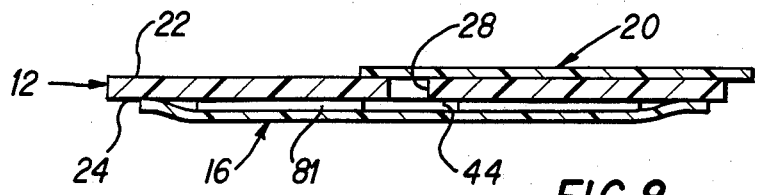
FIG. 8 is an enlarged cross-sectional view illustrating an embodiment of the present invention wherein protrusions extend from one side of the carrier.
Figure 8A:
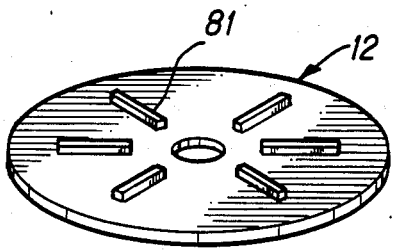
FIG. 8A is a perspective view illustrating an embodiment of the protrusions of FIG. 8.

Several projections 81, FIGS. 8, 8A, may extend from side 24 of carrier 12. Such projections can be of any suitable structure and only one of which is illustrated as exemplary. Projections 81, in this example, are formed as plurality of radial ribs of ridges which may be formed, such as by injection molding, with carrier 12 or attached thereto. Window 16 extends over projections 81 and is suitably attached to carrier 12. Thus, cavity 44 having uniform thickness, is provided between window 16 and surface 24 of carrier 12. Tab 20 seals aperture 28 on side 22 of carrier 12.

Figure 9:
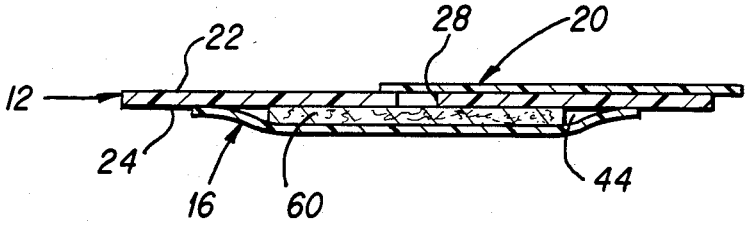
FIG. 9 is an enlarged cross-sectional view illustrating an embodiment of the present invention wherein a blotter is between the window and the carrier.

Blotter 60, discussed above, may also function to maintain a space between carrier 12 and window 16. As illustrated in FIG. 9, blotter 60 is mounted between carrier 12 and window 16. Attachment of window 16 to carrier 12 defines cavity 44 having blotter 16 mounted therein functioning to provide capillary wicking and as a space maintainer. Tab 20 is provided to seal aperture 28.

Figure 10:
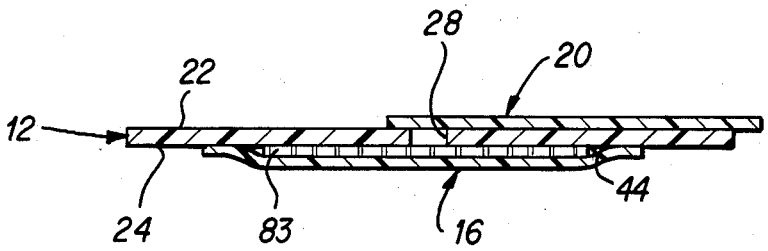
FIG. 10 is an enlarged cross-sectional view illustrating an embodiment of the present invention wherein a mesh member is between the carrier and the window.
Figure 10A:
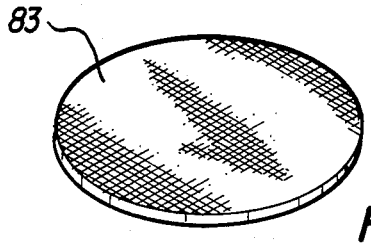
FIG. 10A is a perspective view illustrating the mesh member of FIG. 10.

A further example, FIGS. 10, 10A, illustrates a mesh member 83 mounted between window 16 and carrier 12. A mesh of a suitable size, e.g. well-known window screen, may be utilized for this purpose. Although mesh member 83 of this type does not provide capillary wicking as with blotter 60, it is suitable to provide the desired space between carrier 12 and window 16, defining cavity 44, and assists in providing an even distribution of a liquid sample in cavity 44.

Figure 11:
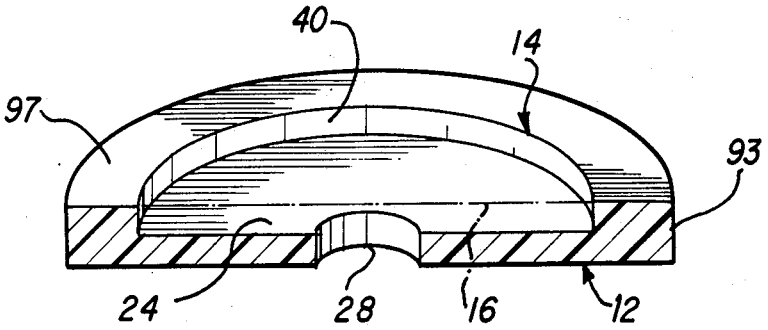
FIG. 11 is an enlarged cross-sectional view illustrating an embodiment of a molded carrier including a volume spacer formed therewith.
Figure 12:
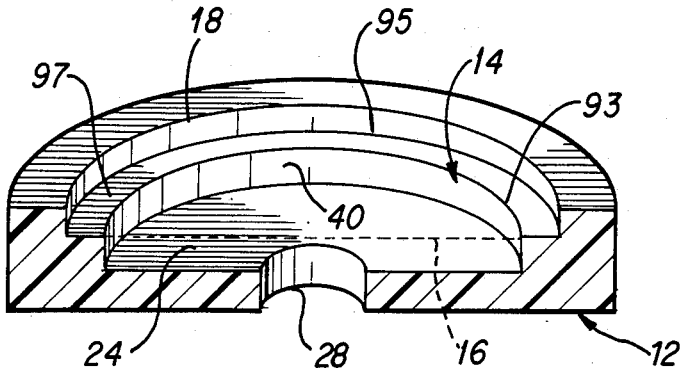
FIG. 12 is an enlarged cross-sectional view illustrating another embodiment of a molded carrier including a volume spacer and a window spacer formed therewith.

Carrier 12, FIGS. 11, 12, may be molded to include a first circumferential raised ring 93 functioning as volume spacer 14 and, alternatively, to include a second circumferential raised ring 95 superimposed, in a stepped manner, on ring 93 to function as window spacer 18. A surface 97 of ring 93 provides a land for adhering window 16 thereto thus defining cavity 44 between surface 24 of carrier 12, inner periphery 40 of ring 93 and window 16.

Figure 13:
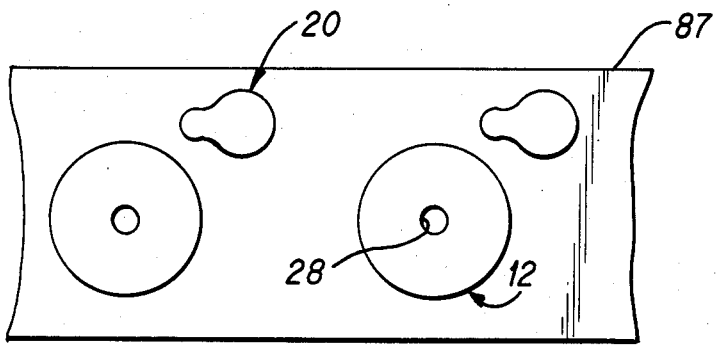
FIG. 13 is a partial plan view illustrating an embodiment of a carrier tape having carriers and tabs mounted thereon.
Figure 13A:
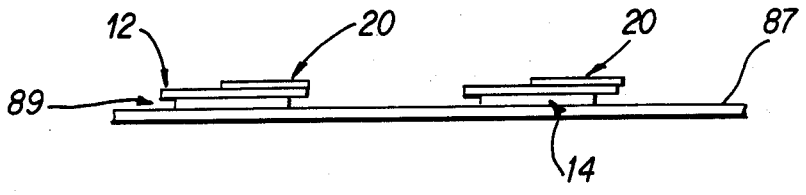
FIG. 13A is a partial side elevational view illustrating an embodiment of a carrier tape having carriers mounted thereon.

Containers 10 may be conveniently packaged on a suitable carrier tape 87 illustrated in FIGS. 13, 13A. Prior to insertion of a sample, containers 10 and tabs 20 are separately mounted on tape 87, with carrier 12 facing upwardly and spacer 14 or spacers 14, 18 facing downwardly so as to provide a space 89 between carrier 12 and carrier tape 87. Once a sample is placed into container 10, tab 20 is adhered to carrier 12 to seal aperture 28 and container 10 may be mechanically manipulated to another work station such as a detector, a drying operation, or the like, depending on the particular sample. Space 89 provides a convenient gripping point for a mechanical manipulator, e.g. robotic arm, (FIG. 15) to grip container 10 and transfer the same to another work station.

Figure 14:
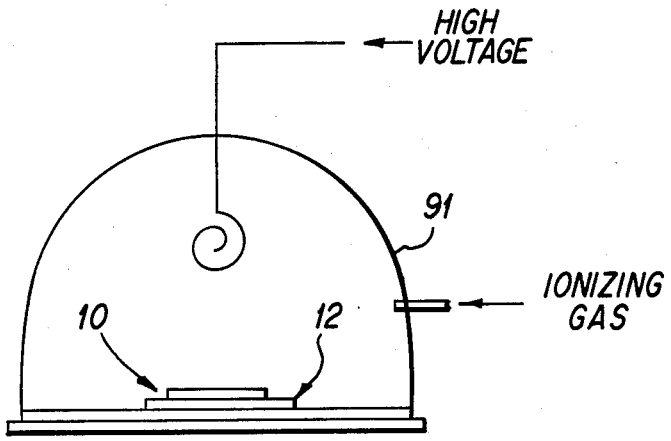
FIG. 14 is a diagrammatic view illustrating an embodiment of the container of this invention used with an exemplary radiation detection device.

An exemplary detector may include the well-known planchette counter 91 such as that diagrammatically illustrated in FIG. 14. An advantage of container 10 is that a liquid sample, being sealed in container 10, may be immediately introduced to the counter 91 since the sealed liquid sample cannot interfere with the sensitive gas volume of planchette counter 91.

Figure 15:
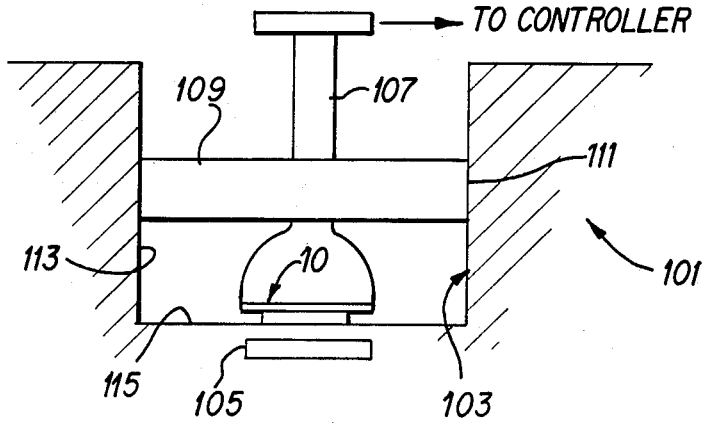
FIG. 15 is a diagrammatic view illustrating an embodiment of the container of this invention used with another exemplary radiation detection device.

Another exemplary detector, FIG. 15, may include the currently available bench top radiation detection device 101, wherein sample containers 10 are placed in a sample holder well 103 and positioned on a surface 115 at a fixed distance from a solid state detection element 105. In order to maintain containers 10 centered in well 103, a mechanical manipulator 107, such as that described above for gripping and removing container 10 from tape 87, may include a suitable fixture 109 having a circumferential surface 111 which slips fits into associated surface 113 of well 103. In this manner, containers 10 can be delivered to detection device 101, the samples tested, and the container 10 removed entirely by mechanical manipulation.

The present invention eliminates or reduces many problems associated with previously used sample containers. First, the sample containers are very small reducing the amount of radioactive waste which must be disposed. Second, the samples once introduced into the sample containers require no further handling, mixing, or other toxic chemicals in order to be counted. They retain their biological activity and can be recovered for use in further biological experimentation if necessary. Third, these sample containers can be presented to a direct ionization detector and have a sufficiently thin exit window that significant amounts of the radioactive emissions from carbon-14 and sulfur-35 can penetrate out of the sample containers and into the detector. Appropriate ionization detectors include solid state detectors and gas proportional or Geiger counters.

The major advantage of the present invention sample containers is that the samples can be sealed inside thereby preventing mechanical contact with the radioactivity, and furthermore that liquid samples as well as dry samples can be accurately counted. With the ability to count liquid samples, drying requirements can be eliminated for faster analysis.

What is claimed is:

1. A container for low energy radioactive samples comprising:

a substantially planar carrier member having first and second opposed sides and an aperture formed therethrough;

means for retaining a radioactive sample in said container and simultaneously for permitting low energy radiation from radioactive decay of the sample to exit therethrough, said means being connected to one side of said carrier member defining a cavity therewith, said cavity only being accessible via said aperture in said carrier member; and means removably attached to another side of said carrier member, opposite said one side, for sealing said aperture.

2. The container of claim 1, wherein said means for retaining includes a transparent window member.

3. The container of claim 1, wherein said carrier member is a substantially disk-shaped member.

4. The container of claim 1, including:

means for spacing said means for retaining from said one side of said carrier.

5. The container of claim 4, wherein said means for spacing comprises projections extending from said one side.

6. The container of claim 5, wherein said projections are formed with said carrier member.

7. The container of claim 5, wherein said projections are attached to said carrier member.

8. The container of claim 4, wherein said means for spacing comprises a ring-shaped volume spacer extending from said one side.

9. The container of claim 8, wherein said spacer is attached to said carrier member.

10. The container of claim 8, wherein said spacer is formed with said carrier member.

11. The container of claim 4, wherein said means for spacing comprises a blotter in said cavity.

12. The container of claim 11, wherein said blotter has an aperture formed therethrough.

13. The container of claim 8, including:

a blotter in said cavity.

14. The container of claim 13, wherein said blotter includes an aperture formed therethrough.

15. The container of claim 4, wherein said means for spacing comprises a mesh member.

16. The container of claim 8, including:

a mesh member in said cavity.

17. The container of claim 4, including:

a window spacer having an opening formed therethrough.

18. The container of claim 8, including:

a window spacer having an opening formed therethrough, said means for retaining being attached to said volume spacer.

19. The container of claim 18, including:

a blotter in said cavity.

20. The container of claim 19, wherein said blotter has an aperture formed therethrough.

21. The container of claim 1, wherein said aperture in said carrier includes a first diameter which gradually expands to a second diameter between said opposed sides.

22. The container of claim 21, including:

a window spacer having an opening formed therethrough.

23. The container of claim 1, including:

a second aperture formed through said carrier.

24. A container for radioactive samples comprising:

a carrier member having an aperture formed therethrough;

a spacer member having an opening formed therethrough and having one side attached to said carrier member;

a window member attached to another side of said spacer member opposite said one side, said window member permitting low energy radiation from radioactive decays of the sample to exit therethrough, said opening in said spacer member defining a cavity between said carrier member and said window member, said cavity being accessible via said aperture in said carrier member;

spacer means for recessing and exposing said window member, said spacer means mounted on said carrier; and means removably attached to said carrier member for sealing said aperture.

25. The container of claim 24, wherein said carrier member is substantially planar.

26. The container of claim 24, wherein said spacer member includes adhesive on said one side and said opposite side.

27. The container of claim 24, including:

a blotter member mounted between said carrier member and said window member.

28. The container of claim 24, wherein said carrier member has another aperture formed therein.

29. The container of claim 28, wherein said removably attached means seals both apertures formed in said carrier member.

30. The container of claim 24, wherein said carrier member aperture includes a first diameter which gradually expands to a second diameter between a first and a second surface of said carrier, said second diameter being greater than said first diameter.

31. The container of claim 30, wherein said second diameter is adjacent said window member.

32. The container of claim 27, wherein said blotter member includes an aperture formed therein.

33. The container of claim 32, wherein said aperture in said blotter is coaxially aligned with said aperture in said carrier member.

34. The container of claim 24, wherein said carrier member, said spacer member, said window member and said spacer means are interconnected so as to have a common centroidal axis.

35. A container for radioactive samples comprising:

a carrier member having an aperture formed therethrough;

a spacer member having an opening formed therethrough and an adhesive on opposite surfaces thereof, one of said surfaces adhered to said carrier;

a window member covering said spacer opening and being adhered to the other of said spacer surfaces said window member permitting low energy radiation from radioactive decays of the sample to exit therethrough;

a window spacer attached to said window, said window spacer having an opening formed therethrough; and means removably attached to said carrier member for sealing said aperture.

36. The container of claim 35, wherein said carrier member aperture, said spacer member opening and said window spacer opening have a common centroidal axis.

37. The container of claim 35, including:

a blotter member mounted between said carrier member and said window member, said blotter member including an aperture formed therein.

38. The container of claim 37, wherein said carrier member aperture, said spacer member opening, said window spacer opening and said blotter member aperture have a common centroidal axis.

39. The container of claim 35, wherein said carrier member aperture includes a first diameter which gradually expands to a second diameter between a first and a second surface of said carrier, said second diameter being greater than said first diameter.

40. The container of claim 39, wherein said carrier member aperture and said window spacer opening have a common centroidal axis.

41. A laminated container for radioactive samples comprising:

a carrier layer having an aperture formed therethrough;

a first spacer layer having one surface mounted on said carrier layer, said spacer layer having an opening formed therethrough;

a transparent window layer attached to another surface of said first spacer layer opposite said one surface, said window member permitting low energy radiation from radioactive decays of the sample to exit therethrough, said opening in said spacer layer defining a cavity between said carrier layer and said window layer, said cavity being accessible via said aperture in said carrier layer;

a second spacer layer connected to said first spacer layer and having a window exposing opening formed therein; and a tab layer removably adhered to a surface of said carrier layer opposite said first spacer layer.

42. The laminated container of claim 41, including:

a layer of wicking material between said carrier layer and said window layer.

43. The laminated container of claim 41, wherein said layers are interconnected so as to have a common centroidal axis.

44. The laminated container of claim 41, wherein said carrier layer aperture, said first spacer layer opening and said second spacer layer opening have a common centroidal axis.

45. The laminated container of claim 41 wherein said cavity is a disk-shaped cavity.

46. A container for holding a low energy radioactive sample during evaluation of the sample by radioactivity measuring equipment, the container comprising:

a generally flat member having an upper surface and a lower surface and a sample-receiving cavity extending through said member from one of said surfaces to a generally flat window at the other of said surfaces of said member, said window forming one end of said sample-receiving cavity, said window having a thickness sufficient to contain said radioactive samples and yet to permit the passage therethrough of low energy beta radiation from a sample in said cavity; and means cooperating with the said one of said surfaces of said member for selectively enclosing the other end of said sample-receiving cavity to thereby completely contain a radioactive sample in said cavity between the upper and lower surfaces of said member.

47. The container of claim 46 wherein said selective enclosing means comprises a layer of material removably applied to said one of said surfaces of said member to permit access to said sample-receiving cavity for the introduction of a radioactive sample into said cavity.

48. The container of claim 46 wherein said member comprises a first generally flat, disk-shaped member with an aperture therethrough, and a second generally flat, disk-shaped member attached to one surface of said first member and covering one end of said aperture, said second member having an aperture therethrough leading to the aperture in said first member, said window comprising a third generally flat, disk-shaped member attached to the other surface of said first member, whereby said sample-receiving cavity is formed in said first member between the second and third member, access to said cavity being through said aperture in said second member.

49. The container of claim 48 wherein said window comprises a plastic film adhesively attached to said first member.

50. The container of claim 47 wherein said window comprises a plastic film adhesively attached to said other of said surfaces of said flat member.

* * * * *